United States Patent [19]

Prochaska et al.

[11] 4,190,417

[45] Feb. 26, 1980

[54] PROCESS FOR DYEING AND PRINTING SHEETS

[75] Inventors: Helmuth Prochaska, Warren, N.J.; Gert F. Baumann, Pittsburgh, Pa.; Peter Rasche, Aachen, Fed. Rep. of Germany; Heinz Müller; Alberto Gonzales-Dörner, both of Leverkusen, Fed. Rep. of Germany

[73] Assignees: Mobay Chemical Corporation, Pittsburgh, Pa.; Bayer Aktiengesellschaft, Leverkusen, Fed. Rep. of Germany

[21] Appl. No.: 846,867

[22] Filed: Oct. 31, 1977

[30] Foreign Application Priority Data

Nov. 11, 1976 [DE] Fed. Rep. of Germany ..... 2651392

[51] Int. Cl.[2] ..... D06P 1/00

[52] U.S. Cl. ..... 8/2.5 R; 8/2.5 A; 8/8; 8/12; 8/21 C; 8/54.2

[58] Field of Search ..... 8/2.5 R, 2.5 A

[56] References Cited

U.S. PATENT DOCUMENTS

| | | | |
|---|---|---|---|
| 1,965,257 | 7/1934 | Poschel | 8/2.5 |
| 2,556,078 | 6/1951 | Francis | 8/2.5 |
| 2,911,280 | 11/1959 | Ciogna | 8/2.5 |
| 3,519,456 | 7/1970 | Reed et al. | 428/195 |
| 3,782,896 | 1/1974 | Defago et al. | 8/2.5 |
| 3,932,129 | 1/1975 | Porter | 8/176 |
| 4,021,591 | 5/1977 | De Vries et al. | 428/335 |
| 4,046,936 | 9/1977 | Schachter | 8/2.5 A |
| 4,056,352 | 11/1977 | Mayer | 8/2.5 A |
| 4,058,644 | 11/1977 | De Vries et al. | 8/2.5 A |
| 4,059,471 | 11/1977 | Haigh | 8/2.5 A |

FOREIGN PATENT DOCUMENTS

| | | |
|---|---|---|
| 449926 | 7/1948 | Canada . |
| 7501787 | 8/1975 | Netherlands . |
| 1496892 | 1/1978 | United Kingdom . |

OTHER PUBLICATIONS

Venkataraman's, "The Chemistry of Synthetic Dyes", vol. VIII (Academic Press, 1978), pp. 191–220.

*Primary Examiner*—A. Lionel Clingman
*Attorney, Agent, or Firm*—Gene Harsh; Lawrence S. Pope

[57] ABSTRACT

The present invention is concerned with a process for dry printing or dyeing of sheets. A foam structure is printed or dyed and placed in contact with the sheet to be treated. The composite is subjected to sufficient heat and pressure to destroy the foam structure without significantly damaging the sheet. The result is the sheet surface now appears to carry the printing or dyeing. Among the suitable carrier foams are polyurethane foams. The process finds particular utility in coloring difficult to dye substrates such as cotton, fiber glass or asbestos fabrics with water insoluble dyes.

14 Claims, No Drawings

PROCESS FOR DYEING AND PRINTING SHEETS

FIELD OF THE INVENTION

This invention relates to a process for the dry dyeing and printing of sheets which preferably consist, partly or completely, of a material which cannot be dyed with water-insoluble dyes, a sheet of foam plastics material which has been dyed or printed with a water-insoluble dye being used as the means for transferring the dye.

BACKGROUND OF THE INVENTION

As is known, numerous techniques have been developed for dyeing and printing sheets. Dyes which have an affinity for their substrate, for example, can be directly applied from an aqueous dye bath or suitable organic solvent. Dyes which are insoluble or have no affinity with the substrate can in many cases be applied to the surface by means of a suitable binder, (for example vinyl polymers or copolymers, copolymers of maleic acid anhydride and ethylene, etc). Certain dyes which have no affinity for the substrate but are capable of sublimation can be applied to a substrate by sublimation.

Many fabrics, in particular cotton fabrics and sheets based on glass or asbestos fibers generally cannot be dyed or printed satisfactorily with the known techniques. The colors obtained are usually unstable and dissolve from the fiber, e.g. in washing.

SUMMARY OF THE INVENTION

It has now surprisingly been found that even substrates of this kind can be printed or dyed very simply and with satisfactory results, if a colored or printed sheet of foam plastics material is used as transfer for the dye. The foam plastics sheet is pressed to the substrate to be dyed at a temperature above its softening point until the foam structure has been largely destroyed and the substance of the foam has penetrated the substrate. The sheet of foam therefore does not serve as coating for the substrate but merely as a transfer for the dye.

The process according to the invention is not, of course, restricted to substrates of the kind mentioned above, which are difficult to dye, but can equally well be used for dyeing or printing any sheets. The advantage in all cases is that the process can be carried out without solvent and that the invention makes it possible to produce dyes and prints which, together with the foam transfer, can be stored and dispatched as desired and need then only be pressed to the desired substrate with heat to produce the end product.

The lamination of textile substrates with polyurethane foams accompanied by partial melting of the surface of the foam has been described in U.S. Pat. No. 2,957,793 and in German Auslegeschrift No. 1,016,680. In these processes, however, the foam structure is substantially preserved and the textiles finally obtained are coated with a sheet of foam whereas in the process according to the invention the thin sheets of foam used as dye transfers are melted and for the most part absorbed by the substrate so that the characteristic appearance and nature of the sheet which has been dyed, preferably a textile sheet, is substantially preserved.

DETAILED DESCRIPTION OF THE INVENTION

The present invention thus relates to a process for the dry dyeing or printing of sheets by transfer printing, characterized in that the sheets are brought into close contact under pressure and at a temperature of from about 160° to 350° C., preferably about 200° to 280° C., with a sheet of foam which has been dyed and/or printed with water-insoluble dyes and which softens at this temperature, contact being maintained until the foam structure of the sheet has been substantially destroyed.

Suitable sheets which can be dyed or printed by the process according to the invention include, for example, woven and knitted textile fabrics, non-woven webs, carpets, foils and metal sheets.

The following are examples of suitable materials which may be used for these substrates and may be used in the form of mixtures:

(a) cellulose materials such as rayon staple, cotton, linen, jute, hemp, paper or wood;

(b) naturally occurring polyamides such as wool, silk or leather;

(c) mineral fibers such as glass fibers or asbestos;

(d) metals such as copper, aluminum or tin.

The fibers mentioned under (a) are preferred, especially rayon and cotton. Glass fiber fabrics and leather are also particularly suitable. The leather is preferably used in the form of leather waste, which is very much improved by this process.

Mixtures of rayon or cotton and synthetic hydrophobic fibers are also preferred, for example polyamides, polyurethanes, polyolefins, polyacrylonitrile, polyvinyl chloride, cellulose esters and, above all, aromatic polyesters.

Mixtures of cotton and polyester are particularly preferred.

The sheets of foam used as dye transfers in the process according to the invention should be very thin and light so that, as already mentioned above, they do not affect the textile appearance or character of the substrate when they are absorbed by it. They generally have a thickness of 0.1 to 5 mm, preferably 0.2 to 3 mm and most preferably about 0.3 to 2 mm, and a weight per unit area of from 3 to 200 g/m$^2$, preferably 5 to 100 g/m$^2$ and most preferably 10 to 80 g/m$^2$.

The foam sheets may be made of various polymeric materials, for example polyurethanes, polyvinyl chloride, polyolefins, polystyrene, polycarbonates or polyacrylonitrile, but polyurethane foams are preferred for the invention.

As is well known, polyurethane foams are obtained by the reaction of polyisocyanates with higher molecular weight and/or low molecular weight compounds which have groups capable of reacting with isocyanates, in the presence of blowing agents and, optionally, catalysts and other additives.

The foam sheets may be produced from aliphatic, cycloaliphatic, aromatic or heterocyclic polyisocyanates such as those described, for example, by W. Siefken in Justus Liebigs Annalen der Chemie, 562 pages 75 to 136, for example ethylene diisocyanate; tetramethylene-1,4-diisocyanate; hexamethylene-1,6-diisocyanate; dodecane-1,2-diisocyanate; cyclobutane-1,3-diisocyanate; cyclohexane-1,3- and 1,4-diisocyanate and any mixtures of these isomers; 1-isocyanate-3,3,5-trimethyl-5-isocyanatomethyl-cyclohexane as described in German Auslegeschrift No. 1,202,785 and U.S. Pat. No. 3,401,190; hexahydrotolylene-2,4-diisocyanate and -2,6-diisocyanate and any mixtures of these isomers; hexahydrophenylene-1,3-diisocyanate and/or 1,4-diisocyanate; perhydrodiphenylmethane-2,4'-diisocyanate and/or 4,4'-diisocyanate; phenylene-1,3-diisocyanate and -1,4-diisocyanate; tolylene-2,4-diisocyanate and -2,6-diisocyanate and any mixtures of these isomers; diphenylmethane-2,4'-diisocyanate and/or 4,4'-diisocyanate; naphthylene-1,5-diisocyanate; triphenylmethane-4,4',4''-triisocyanate, polyphenylpolymethylene polyisocyanates which can be obtained by aniline formaldehyde condensation followed by phosgenation and which have been described, for example, in British Pat. No. 874,430 and No. 848,671; m- and p-isocyanatophenyl-sulphonyl isocyanates according to U.S. Pat. No. 3,454,606; aryl polyisocyanates such as those described, for example, in German Auslegeschrift No. 1,157,601 (U.S. Pat. No. 3,277,138); polyisocyanates having carbodiimide groups as described in German Pat. No. 1,092,007 (U.S. Pat. No. 3,152,162); diisocyanates of the kind described in U.S. Pat. No. 3,492,330; polyisocyanates with allophanate groups as described e.g. in British Pat. No. 994,890; Belgian Pat. No. 761,626 and published Dutch patent application No. 7,102,524; polyisocyanates with isocyanurate groups, e.g. as described in U.S. Pat. No. 3,001,973; German Pat. No. 1,022,789; 1,222,067 and 1,027,394 and German Offenlegungsschriften No. 1,929,034 and 2,004,048; polyisocyanates with urethane groups as described e.g. in Belgian Pat. No. 752,261 or U.S. Pat. No. 3,394,164; polyisocyanates with acylated urea groups according to German Pat. No. 1,230,778; polyisocyanates with biuret groups as described e.g. in German Pat. No. 1,101,394 (U.S. Pat. No. 3,124,605 and No. 3,201,372) and British Pat. No. 889,050; polyisocyanates prepared by telomerization reactions as described for example in U.S. Pat. No. 3,654,106, polyisocyanates having ester groups, such as those mentioned, for example, in British Pat. No. 965,474 and No. 1,072,956; U.S. Pat. No. 3,567,763 and German Pat. No. 1,231,688; reaction products of the above mentioned isocyanates with acetals according to German Pat. No. 1,072,385 and polyisocyanates containing polymeric fatty acid groups according to U.S. Pat. No. 3,455,883.

The distillation residues obtained from the commercial production of isocyanates and still containing isocyanate groups may also be used, optionally as solutions in one or more of the above mentioned polyisocyanates. Any mixtures of the above mentioned polyisocyanates may also be used.

The foams used according to the invention are preferably based on aliphatic and cycloaliphatic isocyanates or on tolylene diisocyanates containing from about 20 to 100% of the 2,6-isomer because these have a fastness to light and resistance to yellowing which is particularly suitable for their purpose.

The starting components used according to the invention also include compounds, generally with a molecular weight of about 400 to 10,000 which have at least two hydrogen atoms capable of reacting with isocyanates. These compounds may contain amino groups, thiol groups or carboxyl groups but are preferably polyhydroxyl compounds, in particular compounds having from two to eight hydroxyl groups, especially those with a molecular weight of from about 800 to 10,000 and preferably about 1000 to 6000, e.g. polyesters, polyethers, polythioethers, polyacetals, polycarbonates and polyester amides having at least two generally two to eight but preferably two to four hydroxyl groups, of the kind known per se for the production of both homogeneous and cellular polyurethanes.

Suitable polyesters with hydroxyl groups include e.g. reaction products of polyvalent, preferably divalent alcohols, to which trivalent alcohols may be added, and polyvalent, preferably divalent carboxylic acids. Instead of free polycarboxylic acids, the corresponding polycarboxylic acid anhydrides or corresponding polycarboxylic acid esters of lower alcohols or mixtures thereof may, of course, be used for preparing the polyesters. The polycarboxylic acids may be aliphatic, cycloaliphatic, aromatic and/or heterocyclic and they may be substituted, e.g. by halogen atoms, and/or unsaturated.

The following are mentioned as examples: Succinic acid; adipic acid; suberic acid; azelaic acid; sebacic acid; phthalic acid; isophthalic acid; trimellitic acid; phthalic acid anhydride; tetrahydrophthalic acid anhydride; hexahydrophthalic acid anhydride; tetrachlorophthalic acid anhydride; endomethylene tetrahydrophthalic acid anhydride; glutaric acid anhydride; maleic acid; maleic acid anhydride; fumaric acid; dimeric and trimeric fatty acids such as oleic acid which may be mixed with monomeric fatty acids; dimethyl terephthalate and terephthalic acid-bis-glycol esters. The following are examples of suitable polyvalent alcohols: Ethylene glycol; propylene glycol-(1,2) and -(1,3); butylene glycol-(1,4) and -(2,3); hexanediol-(1,6); octanediol-(1,8); neopentylglycol; cyclohexanedimethanol (1,4-bis-hydroxymethylcyclohexane); 2-methyl-1,3-propanediol; glycerol; trimethylolpropane; hexanetriol-(1,2,6); butanetriol-(1,2,4), trimethylolethane, pentaerythritol; quinitol; mannitol and sorbitol; methylglycoside; diethylene glycol; triethylene glycol; tetraethylene glycol; polyethylene glycols; dipropylene glycol; polypropylene glycols; dibutylene glycol and polybutylene glycols. The polyesters may also contain a proportion of carboxyl end groups. Polyesters of lactones such as δ-caprolactone or hydroxycarboxylic acids such as ω-hydroxycaproic acid may also be used.

The polyethers used according to the invention which have at least two generally two to eight and preferably two to three hydroxyl groups are also known per se and are prepared, for example, by polymerization of epoxides such as ethylene oxide; propylene oxide; butylene oxide, tetrahydrofuran; styrene oxide or epichlorohydrin, either each on its own, e.g. in the presence of boron trifluoride or by addition of these epoxides, either as mixtures or successively, to starting components having reactive hydrogen atoms, such as water, alcohols or amines, e.g. ethylene glycol; propylene glycol-(1,3) or -(1,2); trimethylolpropane; 4,4'-dihydroxydiphenylpropane; aniline; ethanolamine or ethylene diamine. Sucrose polyethers may also be used according to the invention, e.g. those described in German Auslegeschriften No. 1,176,358 and 1,064,938. It is in many cases preferred to use polyethers which contain predominantly primary hydroxyl groups (up to 90% by weight, based on all the hydroxyl groups present in the polyether). Polyethers modified with vinyl polymers, e.g. the compounds obtained by polymerization of styrene or acrylonitrile in the presence of polyethers as described in U.S. Pat. No. 3,383,351; 3,304,273; 3,523,093 and 3,110,695 and German Pat. No. 1,152,536 are also suitable, as well as polybutadienes which have hydroxyl groups.

Particularly to be mentioned among the polythioethers are the condensation products obtained by reacting thiodiglycol on its own and/or with other glycols, dicarboxylic acids, formaldehyde, aminocarboxylic acids or amino alcohols. The products obtained are polythio mixed ethers, polythio ether esters or polythio ether ester amides, depending on the cocomponents.

Suitable polyacetals include, for example, the compounds which can be prepared from glycols such as diethylene glycol, triethylene glycol, 4,4'-dioxethoxydiphenyl dimethylmethane, hexanediol and formaldehyde. Suitable polyacetals for the purpose of the invention may also be prepared by the polymerization of cyclic acetals.

The polycarbonates with hydroxyl groups used may be of the kind known per se, for example those which can be prepared by the reaction of diols such as propanediol-(1,3), butanediol-(1,4) and/or hexanediol-(1,6), diethylene glycol, triethylene glycol or tetraethylene glycol with diarylcarbonates e.g. with diphenylcarbonate or phosgene.

Suitable polyester amides and polyamides include, for example, the predominantly linear condensates prepared from polyvalent saturated and unsaturated carboxylic acids or their anhydrides and polyvalent saturated and unsaturated aminoalcohols, diamines, polyamines, and mixtures thereof.

Polyhydroxyl compounds already containing urethane or urea groups and modified or unmodified natural polyols such as castor oil, carbohydrates or starch may also be used. Addition products of alkylene oxides and phenol formaldehyde resins or of alkylene oxides and urea formaldehyde resins are also suitable for the purpose of the invention.

Representatives of these compounds which may be used according to the invention have been described, for example, in High Polymers, Vol. XVI, "Polyurethanes, Chemistry and Technology" by Saunders-Frisch, Interscience Publishers, New York, London, Volume I, 1962, pages 32–42 and pages 44–54 and Volume II, 1964, pages 5–6 and 198–199 and in Kunststoff-Handbuch, Volume VII, Vieweg-Hochtlen, Carl-Hanser-Verlag, Munich, 1966, e.g. on pages 45 to 71.

Mixtures of the above mentioned compounds which contain at least two hydrogen atoms capable of reacting with isocyanates and have a molecular weight of from about 400 to 10,000 may, of course, also be used, for example mixtures of polyethers and polyesters.

The starting components used according to the invention may also include compounds with a molecular weight of from about 32 to 400 which have at least two hydrogen atoms capable of reacting with isocyanates. These compounds are also understood to be compounds containing hydroxyl groups and/or amino groups and/or thiol groups and/or carboxyl groups, preferably hydroxyl groups and/or amino groups, and they serve as chain lengthening agents or cross-linking agents. They generally have from two to eight hydrogen atoms capable of reacting with isocyanates, preferably two or three such hydrogen atoms.

The following are examples of such compounds: Ethylene glycol; propylene glycol-(1,2) and -(1,3); butylene glycol-(1,4) and -(2,3); pentanediol-(1,5); hexanediol-(1,6); octanediol-(1,8); neopentyl glycol; 1,4-bis-hydroxymethylcyclohexane; 2-methyl-1,3-propanediol; glycerol; trimethylol propane; hexanetriol-(1,2,6); trimethylolethane; pentaerythritol; quinitol; mannitol and sorbitol; diethylene glycol; triethylene glycol; tetraethylene glycol; polyethylene glycols having a molecular weight of up to about 400; dipropylene glycols with a molecular weight of up to about 400; dibutylene glycol; polybutylene glycols with a molecular weight of up to about 400; 4,4'-dihydroxy-diphenyl propane; dihydroxymethyl hydroquinone; ethanolamine; diethanolamine; triethanolamine; 3-aminopropanol; ethylene diamine; 1,3-diamino propane; 1-mercapto-3-aminopropane; 4-hydroxyphthalic acid; 4-aminophthalic acid; succinic acid; adipic acid; hydrazine; N,N-dimethyl-hydrazine; 4,4'-diaminodiphenylmethane; tolylene diamine; methylene-bis-chloroaniline; methylene-bis-anthranilic acid esters; diaminobenzoic acid esters and the isomeric chlorophenylene diamines.

In this case again there may be used mixtures of various compounds having molecular weights of from about 32 to 400 and containing at least two hydrogen atoms capable of reacting with isocyanates.

The foam sheets used according to the invention may also be produced from polyhydroxyl compounds using high molecular weight compounds in which high molecular weight polyadducts or polycondensates are contained in a finely dispersed or dissolved form. Such modified polyhydroxyl compounds are obtained when polyaddition reactions (e.g. reactions between polyisocyanates and aminofunctional compounds) or polycondensation reactions (e.g. between formaldehyde and phenols and/or amines) are carried out in situ in the above mentioned hydroxyl compounds. Processes of this kind has been described, for example, in German Auslegeschriften No. 1,168,075 and 1,260,142 and in German Offenlegungsschriften Nos. 2,324,134; 2,423,984; 2,512,385; 2,513,815; 2,550,796; 2,550,797; 2,550,833 and 2,550,862. Alternatively, according to U.S. Pat. No. 3,869,413 or according to German Offenlegungsschrift No. 2,550,860, an aqueous polymer dispersion may be mixed with a polyhydroxyl compound and the water may then be removed from the mixture.

Water and/or readily volatile organic substances may be used as blowing agents for producing the foam sheets according to the invention. Suitable organic blowing agents include, for example, acetone, ethyl acetate and halogen-substituted alkanes such as methylene chloride, chloroform, ethylidene chloride, vinylidene chloride, monofluorotrichloromethane, chlorodifluoromethane, and dichlorodifluoromethane as well as butane, hexane, heptane and diethyl ether. The effect of a blowing agent can also be obtained by the addition of compounds which decompose at temperatures above room temperature to release gases such as nitrogen, e.g. azo compounds such as azoisobutyric acid nitrile. Further examples of blowing agents and the use of blowing agents have been described in Kunststoff-Händbuch, Volume VII, published by Vieweg and Hochtlen, Carl-Hanser Verlag, Munich 1966, e.g. on pages 108 and 109, 453 to 455 and 507 to 510.

Catalysts are also frequently used according to the invention. The catalysts added may be known per se, for example tertiary amines such as triethylamine, tributylamine, N-methylmorpholine, N-ethylmorpholine, N-cocomorpholine, N,N,N',N'-tetramethylethylenediamine, 1,4-diaza-bicyclo(2,2,2)-octane, N-methyl-N'-dimethylaminoethylpiperazine, N,N-dimethylbenzylamine, bis-(N,N-diethylaminoethyl)-adipate, N,N-diethylbenzylamine, pentamethyl diethylene triamine, N,N-dimethylcyclohexylamine, N,N,N',N'-tetramethyl-1,3-butanediamine, N,N-dimethyl-$\beta$-phenylethylamine, 1,2-dimethylimidazole and 2-methylimidazole. Mannich bases known per se obtained from secondary amines such as dimethylamine and aldehydes, preferably formaldehyde, or ketones such as acetone, methyl ethyl ketone or cyclohexanone and phenols such as phenol, nonyl phenol or bis-phenol may also be used as catalysts.

Examples of catalysts which consist of tertiary amines having hydrogen atoms which are reactive with isocyanate groups include triethanolamine; triisopropanolamine; N-methyldiethanolamine; N-ethyl-diethanolamine; N,N-dimethylethanolamine and their reaction products with alkylene oxides such as propylene oxide and/or ethylene oxide.

Silaamines having carbon-silicon bonds as described e.g. in German Pat. No. 1,229,290 (corresponding to U.S. Pat. No. 3,620,984) may also be used as catalysts, e.g. 2,2,4-trimethyl-2-silamorpholine or 1,3-diethylaminomethyl-tetramethyl-disiloxane.

Basic nitrogen compounds such as tetraalkylammonium hydroxides, alkali metal hydroxides such as sodium hydroxide, alkali metal phenolates such as sodium phenolate and alkali metal alcoholates such as sodium methylate may also be used as catalysts. Hexahydrotriazines are also suitable catalysts.

Organic metal compounds may also be used as catalysts according to the invention, in particular organic tin compounds.

The organic compounds used are preferably tin(II) salts of carboxylic acids such as tin(II) acetate, tin(II) octoate, tin(II) ethyl hexoate and tin(II) laurate and tin(IV) compounds such as dibutyl tin oxide, dibutyl tin dichloride, dibutyl tin diacetate, dibutyl tin dilaurate, dibutyl tin maleate or dioctyl tin diacetate. All the above mentioned catalysts may, of course, be used as mixtures.

Further examples of catalysts which may be used according to the invention and details concerning the activity of the catalysts are given in Kunststoff-Handbuch, Volume VII, published by Vieweg and Höchtlen, Carl-Hanser-Verlag Munich 1966, e.g. on pages 96 to 102.

The catalysts are generally used in a quantity of from 0.001 to 10% by weight, based on the quantity of compounds with a molecular weight of from about 400 to 10,000 which have at least two hydrogen atoms capable of reacting with isocyanates.

Surface active additives such as emulsifiers and foam stabilizers may also be used according to the invention. Suitable emulsifiers include e.g. the sodium salts of ricinoleic sulphone or salts of fatty acids with amines such as oleic acid diethylamine or stearic acid diethanolamine. Alkali metal or ammonium salts of sulphonic acids such as dodecylbenzenesulphonic acid or dinaphthylmethane disulphonic acid or of fatty acids such as ricinoleic acid or of polymeric fatty acids may also be used as surface active additives.

Suitable foam stabilizers are particularly the polyether siloxanes, and especially those which are water-soluble. These compounds generally have a polydimethylsiloxane group attached to a copolymer of ethylene oxide and propylene oxide. Foam stabilizers of this kind have been described, for example, in U.S. Pat. Nos. 2,834,748; 2,917,480 and 3,629,308.

Other additives which may also be used according to the invention include reaction retarders, e.g. substances which are acid in reaction such as hydrochloric acid or organic acid halides; cell regulators known per se such as paraffins or fatty alcohols or dimethyl polysiloxanes; pigments, dyes; flame retarding agents known per se such as tris-chloroethylphosphate, tricresyl phosphate or ammonium phosphate and polyphosphate; stabilizers against ageing and weathering; plasticizers; fungistatic and bacteriostatic substances and fillers such as barium sulphate, kieselguhr, carbon black or whiting.

Other examples of surface active additives, foam stabilizers, cell regulators, reaction retarders, stabilizers, flame retarding substances, plasticizers, dyes, fillers and fungistatic and bacteriostatic substances which may be used according to the invention and details concerning the use and mode of action of these additives may be found in Kunststoff-Handbuch, Volume VII, published by Vieweg and Höchtlen, Carl-Hanser Verlag, Munich 1966, e.g. on pages 103 to 113.

According to the invention, the components are reacted together by the known one-shot, prepolymer or semiprepolymer process, often using mechanical devices such as those described in U.S. Pat. No. 2,764,565. Details concerning processing apparatus which may be used according to the invention may be found in Kunststoff-Handbuch, Volume VII, published by Vieweg and Höchtlen, Carl-Hanser-Verlag, Munich 1966, e.g. on pages 121 to 205.

The foams are then cut up into sheets of the required thickness in known manner.

The foams according to the invention are preferably soft elastic foams based on polyester polyols having a molecular weight of from about 1,000 to 4,000 and a hydroxyl number in the range of from about 30 to 100, because these foams have a particularly suitable softening range for the purpose of the invention and their melts are very tacky and can therefore be firmly bonded to the substrate.

According to the invention, it is also preferred to use polyurethane foams based on dispersions of polyureas and/or polyhydrazodicarbonamides on polyether polyols, polyester polyols and polyether/polyester-polyol mixtures.

Particularly preferred are foams based on polyureapolyhydrazodicarbonamide dispersions in polyester polyols having a molecular weight of from about 1,000 to 4,000 and a hydroxyl number in the range of from about 30 to 100 and/or in polyether polyols having a molecular weight of from about 1,000 to 6,000 and hydroxyl numbers of between about 15 and 100.

It is known that the stoichiometric proportions of hydroxyl to isocyanate groups can be varied within wide limits in the production of foams. According to the invention, foams which have been produced with a stoichiometric ratio of OH:NCO of between about 1:0.5 and 1:1.1 are particularly preferred, because these foams have a low softening range which is more suitable for the purpose for which they are to be used and they also have the advantage of being more tacky and adhering more firmly to the substrates which are required to be colored.

The foam sheets can be produced by conventional methods i.e. by splitting or peeling blocks of foam or by casting on a substrate.

According to the invention, there may also be used foam sheets which have been produced in known manner by beating air into aqueous dispersions of ionic or non-ionic polyurethanes by the process according to German Offenlegungsschrift No. 2,231,411 (U.S. Pat. No. 3,989,870 incorporated herein by reference) or German Offenlegungsschrift No. 2,343,292 (U.S. Pat. No. 3,989,869 incorporated herein by reference).

Dyeing and/or printing of the foam sheets is also carried out in known manner. Dyeing is carried out in the usual apparatus such as padding machines or beam dyeing apparatus while printing may be carried out on film printing, rotary printing, roller printing, screen printing or flexoprinting machines. The printing pastes and dye liquors are preferably aqueous.

The binders used for preparing the printing pastes may be emulsion polymers of $\alpha,\beta$-unsaturated compounds such as acrylic esters; methacrylic esters; styrene; styrene derivatives; acrylonitrile; vinyl ethers, vinyl esters; vinylidene chloride; acrylic acid; acrylamide; methacrylic acid; methacrylamide; butadiene and mixtures of these monomers. Binders of this kind have been described for example, in German Auslegeschrift No. 1,619,660.

When using foam sheets printed on one side only, it is advisable to use binders which form a slightly thermoplastic film, whereas when using sheets printed on both sides, it may be advantageous if the side facing the substrate is printed with a paste which contains binders of the kind which form highly thermoplastic films.

Suitable binders also include those based on aqueous polyurethane dispersions such as those described, for example, in German Auslegeschrift No. 1,619,668, i.e. compounds which are obtained by polyaddition of higher molecular weight compounds containing several reactive hydrogen atoms and having a molecular weight of from 300 to 20,000 polyisocyanates and, optionally, chain lengthening agents and compounds containing at least one active hydrogen atom and at least one sulphonate group and/or carboxylic group or a sulphonic and/or carboxylic acid group which is capable of salt formation.

Printing pastes containing such binders are built up as oil-in-water emulsions. The substances which provide the viscosity are preferably emulsions of heavy petrol in water. In addition to containing emulsified heavy petrol, the external aqueous phase contains firstly, pigment, polyurethane particles, and, optionally, relatively small quantities of hydrophobic carbamide resins, all in a dispersed form, and, secondly, in a dissolved form, optionally relatively small quantities of thickeners (e.g. cellulose derivatives, polymannurates, tragacanth) and water soluble carbamide resin in addition to dispersing and emulsifying agents.

Fixing of the films and prints produced with these binders is preferably carried out after a hot air treatment at about 130°-140° C. for about 10 minutes; shorter fixing times are sufficient at higher fixing temperatures—it may be taken as a rule of thumb that an increase in temperature of approximately 10 degrees Centigrade doubles the reaction velocity.

Water soluble binders based on copolymers of acrylic esters (20-70% by weight); methacrylic acid esters (20-40% by weight) and acrylic acid (10-20% by weight), i.e. polymers which have a relatively high carboxyl group content, are also suitable for producing the pastes.

Water soluble binders based on copolymers of acrylic esters (20-70% by weight); methacrylic acid esters (20-40% by weight) and acrylic acid (10-20% by weight), i.e. polymers which have a relatively high carboxyl group content, are also suitable for producing the pastes.

Copolymers of this kind have been described, for example, on German Auslegeschrift No. 2,161,909.

Lastly, there may also be used binders based on aqueous dispersions of copolymers of maleic acid anhydride and ethylene, e.g. as described in U.S. Pat. No. 2,930,775; 2,857,365; 3,000,840; 3,165,486 and 3,262,898.

The dyes incorporated in the printing pastes may be ordinary commercial pigments, sublimiation-fast dispersion dyes or water insoluble white toners or various kinds. The printing pastes may also contain flame retardants, plasticizers, fillers and other usual additives.

If desired, the dyes may already be added to the reaction mixture used for producing the foams, and in this way a uniformly colored foam can be obtained. When preparing polyurethanes, which are preferred according to the invention, it is advisable to use dispersion dyes having free hydroxyl and/or amino groups.

The transfer printing of the foam sheets on the substrate may be carried out by means of calender rollers, thermopresses, ironing machines or the like. It may be carried out at a slight excess pressure (approx. 0.2 to 1 excess atmosphere), depending on the time of application of the pressure, the softening temperature of the foam and the absorbency of the substrate, but it may also be carried out at pressures of up to 100 excess atmospheres.

The foam sheet is generally kept in contact with the substrate for from about 5 seconds to 5 minutes, preferably about 10 to 30 seconds.

Dyeings and prints produced by the process according to the invention have exceptional clarity and good general fastness properties. A not undesirable change in the handle is obtained as a side effect; for example, when polyurethane foam sheets are used as supports and cotton fabrics as substrates, the colored goods obtained as end products have a velvety, suede-like finish.

Compared with conventional dry dyeing processes, for example heat transfer printing, in which dyes which can be sublimited are transferred from an auxiliary support, usually a paper support, to the substrate (e.g. a cotton fabric) which has been treated with a polymer which is capable of absorbing dyes, the new process has the advantage that no waste is produced in the form of more or less exhausted auxiliary support, and moreover the new method is more universal in its possible applications and frequently also more economical, and the dyeings and prints produced according to the invention generally have substantially superior fastness properties.

While the printed materials of organic origin produced according to the invention are used mainly in the clothing and artificial leather industry, substrates of inorganic origin treated according to the invention have numerous other possibilities of application. For example, substrates of glass fibers or asbestos treated with the foam sheets could be used as flame resistant covers for seat upholstery. Compared with conventional covers, made of these substrates, they would have the advantage of being less liable to cause injury because fragments of the fibers remain firmly bonded to the foam sheets which have been pressed to the surface. Furthermore, any substrates, in the form of sheets could be dyed or printed on both sides by the process according to the invention, for example for the manufacture of colored curtains, table cloths, furniture covers, decorative materials, tea cloths, etc.

In the case of curtains made of glass fibers, for example, the outside could be covered with a white layer reflecting light and heat while the inside could be covered with any colored pattern.

Interesting effects can also be obtained by treating the sheets used as substrates with differently printed foam sheets on the two sides.

The polyurethane foam sheets used in the Examples were produced as follows:

FOAM SHEET 1

100 g of a polyether (hydroxyl number 49) prepared from propylene oxide ethylene oxide and trimethylol propane are mixed with
3 g of water,
1 g of a commercial polyether siloxane as foam stabilizer (e.g. stabilizer OS 20 of Bayer AG Leverkusen),
0.1 g of 1,4-diaza-(2,2,2)-bicyclooctane (triethylenediamine),
0.18 g of tin dioctoate and
39.4 g of a mixture of 2,4- and 2,6-diisocyanatotoluene (80% 2,4- and 20% 2,6-isomer) and the mixture is applied to the conveyor belt of a foaming machine.

| | | |
|---|---|---|
| gross density | (kg/m$^3$) | 29 |
| tensile strength | (kPa) | 110 |
| elongation at break | (%) | 230 |
| compression resistance at 40% | (kPa) | 3.5 |
| DRV (pressure deformation residue) at 90% deformation | | 3.6 |

FOAM SHEET 2

100 g of a polyether with hydroxyl number 28 prepared from ethylene oxide, propylene oxide and glycerol are mixed with
3 g of water,
1.0 g of a foam stabilizer (polyether siloxane F 115 of Th Goldschmidt, Essen),
0.3 g of a tert. amine mixture (® Desmorapid PS 207 of Bayer AG Leverkusen)
0.55 g of tin-(II) octoate and
32.3 g of a mixture of 2,4- and 2,6-isocyanatotoluene (65% 2,4- and 35% 2,6-isomer).
The foam obtained has the following properties:

| | | |
|---|---|---|
| gross density | (kg/m$^3$) | 36 |
| tensile strength | (kPa) | 85 |
| elongation at break | (%) | 610 |
| compression resistance at 40% | (kPa) | 2.5 |
| pressure deformation residue at 90% deformation | (%) | 8.5 |

FOAM SHEET 3

A. Preparation of a polyhydrazodicarbonamide dispersion 800 g of a polyether (hydroxyl number 28, approx. 80% primary hydroxyl groups) prepared from propylene oxide, ethylene oxide and trimethylol propane, 169 g of a mixture of 80% by weight of 2,4- and 20% by weight of 2,6-tolylene diisocyanate and 49 g of hydrazine hydrate are used to prepare a stable, white, finely divided 20% by weight dispersion with hydroxyl number 22.5 by the method described in German Offenlegungsschrift No. 2,550,796 and U.S. patent applications Ser. Nos. 740,451 and 740,452 both filed Nov. 10, 1976 and both incorporated herein by reference.

B. Preparation of the foam 100 g of the dispersion are mixed with 3 g of water, 0.8 g of a polyether siloxane (foam stabilizer B 3136 of Th. Goldschmidt, Essen), 0.15 g of a tertiary amine mixture ®Desmorapid PS 207 of Bayer AG Leverkusen), 0.22 g of tin-(II) octoate and 36.2 g of a mixture of 2,4- and 2,6-diisocyanatotoluene (72.5% 2,4- and 27.5% 2,6-isomer).

The foam obtained has the following properties:

| | | |
|---|---|---|
| gross density | (kg/m$^3$) | 38 |
| tensile strength | (kPa) | 200 |
| elongation at break | (%) | 180 |
| compression resistance at 40% | (kPa) | 7.0 |
| compression deformation residue at 90% deformation | (%) | 7.1 |

FOAM SHEET 4

100 g of a polyether of hydroxyl number 28 which has been obtained by addition of propylene oxide and subsequently ethylene oxide to trimethylol propane and in which 67% by weight of the hydroxyl groups are primary hydroxyl groups are mixed with 3.2 g of water, 3.0 g of diisopropanolamine, 1.5 g of triethanolamine, 0.12 g of 1,4-diaza-(2,2,2)-bicyclooctane, 2.0 g of glycerol and 58.7 g of a tolylene diisocyanate which has allophanate groups (isocyanate content 40.5% by weight; viscosity: 19 cP at 25° C.).

The resulting foam has the following physical properties:

| | | |
|---|---|---|
| gross density | (kg/m$^3$) | 35 |
| tensile strength | (kPa) | 70 |
| elongation at break | (%) | 100 |
| compression resistance at 40% | (kPa) | 2.5 |
| pressure deformation residue at 90% deformation | (%) | 4.0 |

FOAM SHEET 5

100.0 g of a polyether polyol with hydroxyl number 50 prepared from adipic acid, diethylene glycol and trimethylol propane are mixed with
3.6 g of water,
1.4 g of N-methyl-morpholine,
0.05 g of a tertiary amine (®Desmorapid PV of Bayer AG, Leverkusen),
1.5 g of an ethoxylated, propoxylated fatty alcohol with hydroxyl number 52 (dispersing agent EM of Bayer AG, Leverkusen),
1.5 g of a polyoxyethylene fatty acid ester (additive TX of Bayer AG Leverkusen) and
42.2 g of a mixture of 2,4- and 2,6-diisocyanatotoluene (80% 2,4- and 20% 2,6-isomer).
The resulting foam has the following properties:

| | | |
|---|---|---|
| gross density | (kg/m$^3$) | 31 |
| tensile strength | (kPa) | 200 |
| elongation at break | (%) | 410 |
| compression resistance at 40% compression | (kPa) | 3.5 |
| pressure deformation residue at 50% | (%) | 4.5 |

FOAM SHEET 6

100.0 g of a polyether polyol having a hydroxyl number of 50, prepared from adipic acid, diethylene glycol and trimethylol propane are mixed with
3.0 g of water, 12.5 g of N-methyl-morpholine and
0.8 g of a foam stabilizer (polyether siloxane surfactant L 532 of Union Carbide, USA),
10.0 g of a sulphonated tolylene diisocyanate having an isocyanate content of 39% by weight and prepared according to German Offenlegungsschrift No. 2,441,843, or U.S. Pat. No. 4,013,701, incorporated herein by reference,
16.8 g of a mixture of 80% of 2,4- and 20% of 2,6-diisocyanato toluene and
16.8 g of a mixture of 65% of 2,4- and 35% of 2,6-diisocyanato toluene.

The resulting foam has the following properties:

| | | |
|---|---|---|
| gross density | (kg/m$^3$) | 32 |
| tensile strength | (kPa) | 140 |
| elongation at break | (%) | 285 |
| compression resistance at 40% compression | (kPa) | 430 |
| pressure deformation residue at 50% | (%) | 4.5 |

FOAM SHEET 7

(a) preparation of a polyhydrazodicarbonamide dispersion:

1600 g of a polyester (hydroxyl number 60) prepared from adipic acid, diethylene glycol and trimethylol propane, 169 g of a mixture of 80% of 2,4- and 20% of 2,6-tolylenediisocyanate and 49 g of hydrazine hydrate are used to prepare a stable, white, finely divided 10% dispersion having a hydroxyl number of 54 and a viscosity of 39,000 mPa at 25° C. by the method described in German Offenlegungsschrift No. 2,423,984 or U.S. Pat. No. 4,042,537 incorporated herein by reference.

(b) Preparation of the foam 100.0 g of the dispersion described under (a) are mixed with 3.6 g of water,
1.3 g of N-methyl-morpholine,
0.05 g of a tertiary amine (®Desmorapid PC of Bayer AG, Leverkusen),
1.5 g of an ethoxylated, propoxylated fatty alcohol of hydroxyl number 52 (dispensing agent EM of Bayer AG, Leverkusen),
1.5 g of a polyoxyethylene fatty acid ester (additive TX of Bayer AG, Leverkusen) and
42.3 g of a mixture of 80% of 2,4- and 20% of 2,6-diisocyanatotoluene.

The resulting foam has the following properties:

| | | |
|---|---|---|
| gross density | (kg/m$^3$) | 29 |
| tensile strength | (kPa) | 180 |
| elongation at break | (%) | 225 |
| compression resistance at 40% compression | (kPa) | 5.0 |
| pressure deformation residue at 50% | (%) | 6.2 |

FOAM SHEET 8

80.0 g of a polyester polyol (hydroxyl number 60) prepared from adipic acid, diethylene glycol and trimethylol propane are mixed with
20.0 g of a polyether polyol with hydroxyl number 56 prepared from glycerol, propylene oxide and ethylene oxide,
4.0 g of water,
0.4 g of dimethylbenzylamine,
1.5 g of a foam stabilizer (polyether siloxane stabilizer OS 25 of Bayer AG, Leverkusen),
0.1 g of tin dioctoate,
0.5 g of a defoaming agent (silicone oil M 20 of Bayer AG) and
52.2 g of a mixture of 80% 2,4- and 20% 2,6-diisocyanato toluene.

The foam obtained has the following properties:

| | | |
|---|---|---|
| gross density | (kg/m$^3$) | 25 |
| tensile strength | (kPa) | 110 |
| elongation at break | (%) | 230 |
| compression resistance at 40% compression | (kPa) | 2.3 |
| pressure deformation residue at 50% | (%) | 8.7 |

EXAMPLES

EXAMPLE 1

Foam sheets 2 mm in thickness are manufactured from the foams 1 to 8 described above by the conventional methods of splitting or cutting. The sheets are then printed by a process of flat film printing with a mixture of 50 parts by weight of a 40% aqueous dispersion of a blue pigment dye (color index No. 74160), 150 parts by weight of an aqueous dispersion of a copolymer of 69% of butyl acrylate, 25% of acrylonitrile and 6% of acrylic acid, 1 part by weight of ammonium sulphate, 789 parts by weight of a 70% emulsion of heavy petrol in water, and 10 parts by weight of the trimethyl ether of trimethylol melamine. After drying and 5 minutes fixing at 150° C. the unprinted side of the foam sheet is placed on a glass fiber fabric and pressed into contact with it in a thermo-press at 230° C. and 0.475 excess atmospheres for 20 seconds. A glass fiber fabric with very brilliant colors is obtained.

The 70% emulsion of heavy petrol in water is obtained by emulsifying 700 parts by weight of a heavy petrol boiling within the range of 140° to 220° C. in a mixture of 297 parts by weight of water and 8 parts by weight of emulsifying agent (e.g. a reaction product of 1 mol of cetyl alcohol and 15 mol of ethylene oxide), using a high speed stirrer (3,000 to 6,000 revs per min.).

EXAMPLE 2

Foam sheets 1 to 8 are printed on a rotary film printing machine with a mixture of 100 parts by weight of a 30% aqueous dispersion of bitumen-free carbon black, 150 parts by weight of a 40% aqueous dispersion of a copolymer of 62% of butyl acrylate, 30% of styrene, 4% of acrylamide and 4% of acrylic acid, 8 parts by weight of a reaction product of 1 mol of oleyl alcohol and 15 mol of ethylene oxide as emulsifying agent, 122 parts by weight of water, 1 part by weight of ammonium sulphate, 50 parts by weight of a 4% aqueous solution of hydroxyethyl cellulose as additional agent for regulating the consistency of the printing paste and 20 parts by weight of a 50% aqueous solution of hexamethylhexamethylol melamine and 549 parts by weight of heavy petrol which has been thoroughly incorporated by emulsification. The printed sheet is then dried and fixed at 140° C. for 4 minutes. The unprinted side of the foam is placed on a cotton fabric and pressed in contact with it on a thermo-press at 195° C. and 0.475 excess atmospheres for 20 seconds. A brilliant print with pleasant handle is obtained.

EXAMPLE 3

When foam sheets 1 to 8 are flat printed with a mixture of 200 parts by weight of a 60% suspension of titanium oxide in water, 10 parts by weight of a 40% aqueous dispersion of a blue pigment dye (color index No. 74 100), 200 parts by weight of a 40% aqueous dispersion of the copolymer from Example 2, 1 part by weight of ammonium sulphate, 8 parts by weight of o-benzyl-hydroxydiphenyl polyglycol ether in 80 parts by weight of water, 180 parts by weight of a 2.5% aqueous solution of hydroxypropyl cellulose as additional thickener and 20 parts by weight of a 50% aqueous solution of a urea-formaldehyde condensation product in which 301 parts by weight of heavy petrol are emulsified, a well-covering, vigorous turquoise colored print of great brilliance is obtained. After drying and 5 minutes fixing at 150° C. the unprinted side of the foam sheet is placed on a polyester/cotton fabric (67/33) and kept in contact with it at 0.475 excess atmospheres and 205° C. for 25 seconds. A brilliant print with pleasant handle is obtained.

EXAMPLE 4

Foam sheets 1 to 8 are printed on a rotary film printing machine with a mixture of 50 parts by weight of a 40% aqueous dispersion of a red azo dye (color index No. 12370), 200 parts by weight of a 40% aqueous dispersion of a copolymer of 70% butyl acrylate, 20% of acrylonitrile, 6% of acrylamide and 4% of acrylic acid, 10 parts by weight of o-benzyl-oxydiphenylpolyglycol ether, 14 parts by weight of an ammonium salt of a polyacrylic acid having a molecular weight of 100,000 and 726 parts by weight of water, and the printed sheet is then dried and fixed at 150° C. for 5 minutes. The unprinted side of the foam is then placed on a split leather and kept in contact with it at 0.475 excess atmospheres and 220° C. for 30 seconds on a thermocalendering machine. A leather having a colored velvety surface is obtained.

EXAMPLE 5

The foam sheets are printed by a process of film printing with a mixture of 150 parts by weight of bronze powder, 300 parts by weight of a 40% aqueous dispersion of a polyurethane of 420 g of a polyester (hydroxyl number 63) of adipic acid, hexane diol and neopentyl glycol, 63.2 g of hexane-1,6-diisocyanate and 14.38 g of glycocol sodium, 500 parts by weight of a 4% aqueous tragacanth solution and 50 parts by weight of a 50% aqueous solution of trimethyl trimethylol melamine. A well covering bronze (gold) print is obtained after fixing at 140° C. for 5 minutes. The uncolored side of the foam sheet is placed on a glass fiber fabric and kept in contact with it on a thermocalendering machine at 230° C. and a pressure of 0.475 excess atmospheres for 30 seconds.

EXAMPLE 6

The foam sheets are printed on a flat printing machine with a mixture of 10 parts by weight of a dispersion dye of color index disperse violet 50, 850 parts by weight of an approximately 19% aqueous solution of the ammonium salt of an emulsion polymer of 18% of acrylic acid, 0.1% of butane diol diacrylate and 81.9% of ethyl acrylate, 100 parts by weight of a 40% aqueous dispersion of a copolymer of 69% of butyl acrylate, 25% of acrylonitrile and 6% of acrylic acid, 1 part by weight of ammonium sulphate, 20 parts by weight of a 50% aqueous solution of hexamethyl hexamethylol melamine and 19 parts by weight of Ca/Mg carbonate. The printed sheets are dried and fixed at 150° C. for 5 minutes. The unprinted side of the foam sheets is placed on a polyester/cotton (67/33) fabric and kept in contact with it on a thermopress for 22 seconds at 195° C. and a pressure of 0.475 excess atmospheres. A brilliant print with pleasant handle is obtained.

What is claimed is:

1. Process for dry dyeing or printing of sheet-like structures by transfer printing, characterized in that said structures are brought into close contact, under pressure and at a temperature of about 160° to 350° C., with an unsupported foam sheet having a weight per unit area of 3 to 200 g/m$^2$ which has been dyed and/or printed with water insoluble dyes and which softens at this temperature, the said contact being maintained until the foam structure of the sheet has been substantially destroyed.

2. Process according to claim 1, characterized in that it is carried out at temperatures of from about 200° to 280° C.

3. Process according to claim 1, characterized in that sheets of cellulose fibers are used.

4. Process according to claim 1, characterized in that sheets of cotton fabrics or polyester/cotton mixed fabrics are used.

5. Process according to claim 1, characterized in that sheets based on glass and/or asbestos fibers are used.

6. Process according to claim 1, characterized in that the sheets used are split leather.

7. Process according to claim 1, characterized in that the foam sheet used as carrier for the dyes are polyurethane foam sheets.

8. Process according to claim 1, characterized in that the foam sheets are printed with pigment dyes.

9. Process according to claim 1, characterized in that the foam sheets used are printed on one side with printing pastes containing binders which form slightly thermoplastic films.

10. A process of forming seat cushion covers or curtains comprising dry dyeing a sheet structure based on glass and/or asbestos fibers according to the process of claim 1 and forming it into a seat cushion cover or curtain.

11. A process for the dry dyeing or printing of sheet like structures by transfer printing comprising 1. printing or dyeing an unsupported foam structure having a weight per unit area of 3 to 200 g/m$^2$, which is destructible under the effects of heat in excess of ambient temperature and pressure in excess of normal atmospheric,
2. placing the sheet like structure and the foam structure immediately adjacent, and
3. subjecting the composite to sufficient heat and pressure to destroy the foam structure but not so great as to damage the sheet like structure, thereby causing the coloring originally on the foam structure to appear to be on the surface of the sheet like structure.

12. The process of claim 11, wherein the foam structure is made from soft elastic polyurethane foam based on polyester polyols with molecular weights of about 1000 to 4000 and a hydroxyl number of between about 30 and 100.

13. The process of claim 11, wherein the foam structure is a polyurethane foam based on a polyurea polyhydrazodicarbonamide dispersion in a media selected from polyester polyols with molecular weights between about 1000 and 4000 and hydroxyl numbers between about 30 and 100 and polyether polyols with molecular weights between about 1000 and 6000 and hydroxyl numbers between about 15 and 100.

14. The process of claim 11, wherein the foam structure is subjected to a pressure of between about 0.2 and 1 excess atmospheres at between about 160° and 350° C. for between about 5 seconds and 5 minutes to destroy the foam structure without significantly damaging the sheet like structure.

* * * * *